United States Patent [19]

Salger

[11] 4,144,839

[45] Mar. 20, 1979

[54] FEEDING DEVICE FOR SUPPLYING DEVELOPER POWDER TO A MAGNETIC DRUM

[75] Inventor: Werner Salger, Hamburg-Langenhorn, Fed. Rep. of Germany

[73] Assignee: Fa. Lumoprint Zindler KG (GmbH & Co.), Hamburg, Fed. Rep. of Germany

[21] Appl. No.: 832,670

[22] Filed: Sep. 12, 1977

[30] Foreign Application Priority Data

Sep. 24, 1976 [DE] Fed. Rep. of Germany ..... 2643032

[51] Int. Cl.[2] ..... G03G 15/09

[52] U.S. Cl. ..... 118/658

[58] Field of Search ..... 118/657, 658, 654, 653

[56] References Cited

U.S. PATENT DOCUMENTS

| | | | |
|---|---|---|---|
| 3,640,248 | 2/1972 | Nielander | 118/658 |
| 3,828,728 | 8/1974 | Yang | 118/658 |
| 3,881,446 | 5/1975 | Kurita | 118/657 |

OTHER PUBLICATIONS

IBM Technical Disclosure Bulletin, Buckley et al., "Magnetic Brush Developer," vol. 20, No. 1 (Jun. 1977) p. 261.

*Primary Examiner*—Werner H. Schroeder
*Assistant Examiner*—Andrew M. Falik
*Attorney, Agent, or Firm*—Toren, McGeady and Stanger

[57] ABSTRACT

A developing apparatus for developing a latent image, particularly an electrostatically generated latent image on a drum type carrier in a copying machine, wherein a magnet drum carrying a developer powder brush rotates relative to the carrier in close proximity thereof, the feed means for supplying developer powder to the magnet drum including a hollow cone-type pump for throwing developer powder onto an inclined baffle sheet extending toward a bottom portion of the periphery of the magnet drum.

15 Claims, 6 Drawing Figures

FEEDING DEVICE FOR SUPPLYING DEVELOPER POWDER TO A MAGNETIC DRUM

The present invention relates to a developing apparatus for developing a particularly electrostatically generated latent image, the apparatus including a developer powder brush moving on a magnet drum and adapted to be moved contactingly past a latent image-bearing material, particularly of a drum-shaped configuration, whereby the tips of the brush come into relative engagement with this material, and means for conveying developer powder for feeding to the magnet drum.

By the German Offenlegungsschrift Laying-Open specification, No. 2,224,624 there is already known a developing apparatus in which as means for feeding developer powder to the magnet drum there is provided an additional magnet drum within a supply of developer powder. In this prior at arrangement the magnet systems are stationary, and exterior tubular sleeves are driven and rotate. This prior art arrangement as well as other heretofore known arrangements have the drawback that the developer powder feed must extend along the whole axial length of the magnet drum on which is established the developer powder brush. This drawback is substantial because it is likewise necessary for a developer powder replenishment to extend across the whole width of the apparatus. Moreover, there will arise the further drawback that during operation the developer powder mixture consisting of carrier particles and color particles will vary along the length of the magnet drum or respectively the width of the apparatus, and even when supplying replenishment material there cannot be obtained a continuous uniform condition of the developer powder brush.

An additional magnet drum rotating within the supply of developer powder, moreover, brings about the drawback of compressing the surface of the powder in forming a trench having a compressed surface from which the transfer of powder is impeded.

By the German Offenlegungsschrift (Laying-Open specification) No. 1,963,751 it is already known to provide, above a so-called transfer drum having a brush-like circumferential surface, a hopper extending along the axial length of the drum for selectively scattering developer powder from above along the axial length of the transfer drum. This powder will then be transferred to a magnet drum that moves in tangential surface contact with the transfer drum. Apart from its extension across the width of the apparatus, this prior art arrangement is disadvantageous because of its expensive design of numerous gate valves that are arranged side by side and actuated separately for effecting a selective discharge. These gate valves may leak after prolonged use, due to contamination, and this quite apart from the fact that the brush jacket of the transfer drum likewise will gradually become clogged and harden so that there will be no longer ensured a uniform feeding of developer powder to the magnet drum along its axial length.

In the last-described arrangement the supply of developer powder is disposed above the transfer drum. There are likewise known apparatus in which are provided different devices in the form of a bucket conveyor or a pump, for initially establishing a supply. When providing in this arrangement a pump, there would result substantial drawbacks because the powder of a grainy consistency even at a microscopical scale interferes with the positive closing of feed and discharge valve ports of a pump; for this reason there are employed, in arrangements of this type, bucket conveyors of a substantial and complicated mechanical design, for effecting a mixing-free exploitation of the developer powder supply when scooping up the bucket batches, except for the whirling up when emptying the buckets.

It is known e.g. by the British Pat. No. 1,069,615 relating specifically to a fluid developer with dispersed particles, to employ a so-called centrifugal pump consisting of a conical upwardly and outwardly flaring member. In this arrangement it is intended that the centrifugal force not only provides for the upward feed but likewise effects an enrichment of the developing substance of fluid and particles upon discharge, due to the different specific weights. A pump of this type is advantageous for a fluid developer whereby it may also be assumed that such a fluid developer spreads automatically within a developer trough and will rise communicatingly within the conical member when being delivered by the pump.

When employing a dry developer to which the present invention relates, a pump of this type has never been used, although this pump is known in principle by the German Austrian Pat. No. 76,730. The reason for this may have been the fear that the powder type developer may not enter sufficiently into the lower end of the pump. With respect to dry developers one has obviously also believed that for establishing a uniform developer powder brush the dry developer powder must be supplied effectively across the whole width of the developing apparatus or respectively the whole axial length of the magnetic brush, and toward this end there have been employed specific auxiliary means such as additional magnet drums or feed brushes. This has led to an extremely complicated design of developing apparatus with magnet drums for establishing a developer powder brush.

With feed means extending along the axial length of a developer powder brush there have always been encountered problems in the prior art arrangements, and these problems were due to different accumulation of the developer powder or the like, in order to establish a uniform developer powder brush along the length of the magnet drum. These problems are based on the different effects of the feed means.

It is, therefore, the object of the present invention to eliminate these drawbacks and to solve the respective problems by providing a novel and improved developing apparatus of the type as stated in the introductory paragraph of the present specification wherein with simplified feed means at the magnet drum there will be generated an even developer powder brush along the length of the magnet drum, substantially simplifying the design of the apparatus.

This object is being achieved, in accordance with the present invention, by the fact that a baffle sheet approaching the periphery of the magnet drum is associated therewith, and that there is provided at least one drivable pump for projecting the developer powder onto this baffle sheet. The design of the means as a pump for projecting the developer powder onto the baffle sheet already constitutes a particularly advantageous arrangement whereby likewise the combination of the baffle sheet approaching the periphery of the magnet drum provides the pre-requisite for establishing, prior to the transfer of the developer powder into the magnet brush, a zone acting as a developer powder reservoir.

Preferably, a baffle sheet end portion disposed below the magnet drum includes an upwardly bent portion against which may accumulate developer powder. By this, there will be provided, prior to the transfer of the developer powder that is ejected from the pump, a bead-like reservoir zone extending along the axial length of the magnet drum and supplied by the pump, and from which the magnet drum ultimately derives the necessary material for establishing the developer powder brush. In this context, an advantageous characteristic is that the spacing of the baffle sheet from the magnet drum at the adjacent end of the baffle sheet is selected so that at the end of the baffle sheet the magnetic field defines a magnetic zone in which is retained a bead-shaped supply of developer powder from which the magnet drum makes up its brush replenishment.

The arrangement of the present invention exhibits numerous advantages. It has been found that by throwing the developer powder onto the baffle sheet the developer powder is subjected to pulses affecting the adhesion of color particles to carrier particles and leading to a condition between carrier and pigment particles that improves the developer powder sensitivity to development even under low incitement.

It is particularly advantageous when the baffle sheet is upwardly inclined toward the magnet drum, and the developer powder is thrown on an intermediate region or respectively a lower region of the upper surface of the baffle sheet. This ensures the effective establishment of the elongate reservoir zone. This is important if there is provided only one conveyor means as pump for serving the whole length of the magnet drum because the magnet drum will then not be established directly but merely as a supply in front of the magnet drum, and the latter will derive the required developer powder from this supply. Preferably the end portion of the baffle sheet extending toward the pump is bent and dips into the supply of developer powder, in thereby providing a mist barrier at the lower surface of the baffle sheet, for drum-shaped material configuration. This provides for a particularly preferred arrangement of the overall apparatus within a copying machine to which the invention likewise relates.

In a particularly preferred embodiment, there is provided for the at least one pump a hollow cone adapted to be driven about its center axis, the cone dipping, at its bottom end, into a supply of developer powder and being adapted to convey the developer powder along its inner surface toward its upper edge. This provides a very surprising result. Although a hollow cone of this type as a pump is known for a long time already, nobody has ever thought of employing such a hollow cone for a developer powder. This hollow cone provides several advantages already in the upward transport of the developer powder. During upward transport, even in an embodiment with profilings, there will occur a triboelectric charge that is particularly advantageous to developer powder. Apart from this, the developer powder will be subjected to surface stresses that influence the individual particles in a manner so as to improve the sensitivity of the developer powder when subjecting the same to even small effects of a latent electrostatic image. This effect is believed to be particularly important because the special type of pump introduces thereby a functional effect into the development. Even if this were not the case, there still remains the triboelectric influence which occurs automatically whereby the here described pump has the further advantage of feeding and replenishing the magnet drum across the whole axial length thereof from its virtually spatially restricted location likewise allowing a corresponding location of replenishment material, and this effect is further enhanced by the so-called pre-brush, i.e. the accumulation of material on the baffle plate.

In a suitable embodiment the center axis of the hollow cone and the drive shaft thereof are inclined so that the upper circumference at the side facing the baffle sheet is disposed lower than the other circumference. By this arrangement may be achieved that the major quantity of developer powder is projected onto the baffle sheet.

Suitably, the inner surface of the hollow cone is provided with profilings. In an advantageous embodiment, such a profiling may consist of a spiral thread that is machined in the direction of rotation. By this is enhanced the circulation of powder during its transport, is combination with the triboelectric effect.

In another advantageous embodiment, the magnet drum consists of a rotary magnet system of axially extending magnets of alternately opposite polarities rotating within a stationary tubular sleeve made of a non-magnetizable material, and the stationary tubular sleeve mounts a stripper for removing the magnetic brush material of the developer powder, the stripper being disposed at an apex facing away from the optionally cylindrical recording material. Although stationary tubular sleeves are per se conventional, the present embodiment is suitable within the scope of the present invention.

According to another favorable embodiment the driven hollow cone dips into the sump of a hopper-shaped supply reservoir. In this case, the general casing must be of a hopper-shaped configuration.

It is particularly advantageous to provide the hollow cone with means for enhancing the introduction of developer powder. Toward this end it is preferred to provide an annular magnet in the lower portion of the hollow cone that dips into the supply. This annular magnet attracts the developer powder and is advantageous when the hollow cone rotates insofar as the developer powder will be collected in an annular region from which the powder readily migrates upwardly, due to the rotation.

Preferably, the annular magnet is arranged at the lower surface of a spider interconnecting the hollow cone with a drive shaft. Suitably, the outer diameter of the annular magnet is smaller than the inner diameter of the hollow cone in the same plane.

The lower edge of the hollow cone itself may likewise be provided with a particularly internally recessed annular magnet.

According to another advantageous embodiment, a screw conveyor is arranged within a supply reservoir including a trough corresponding to the width of the copying material, and the screw conveyor includes conveyor elements of a configuration for supplying developer powder to the at least one hollow cone. Even when the supply reservoir collects material discharged over the whole length of the magnet drum, this material will be supplied to the pump having simultaneously the function of a mixing element.

In the following the present invention will be described with reference to a preferred embodiment that is shown in the appended drawing wherein FIG. 1 is a cross-sectional elevational view of a preferred embodiment of the present invention;

Figure 1:
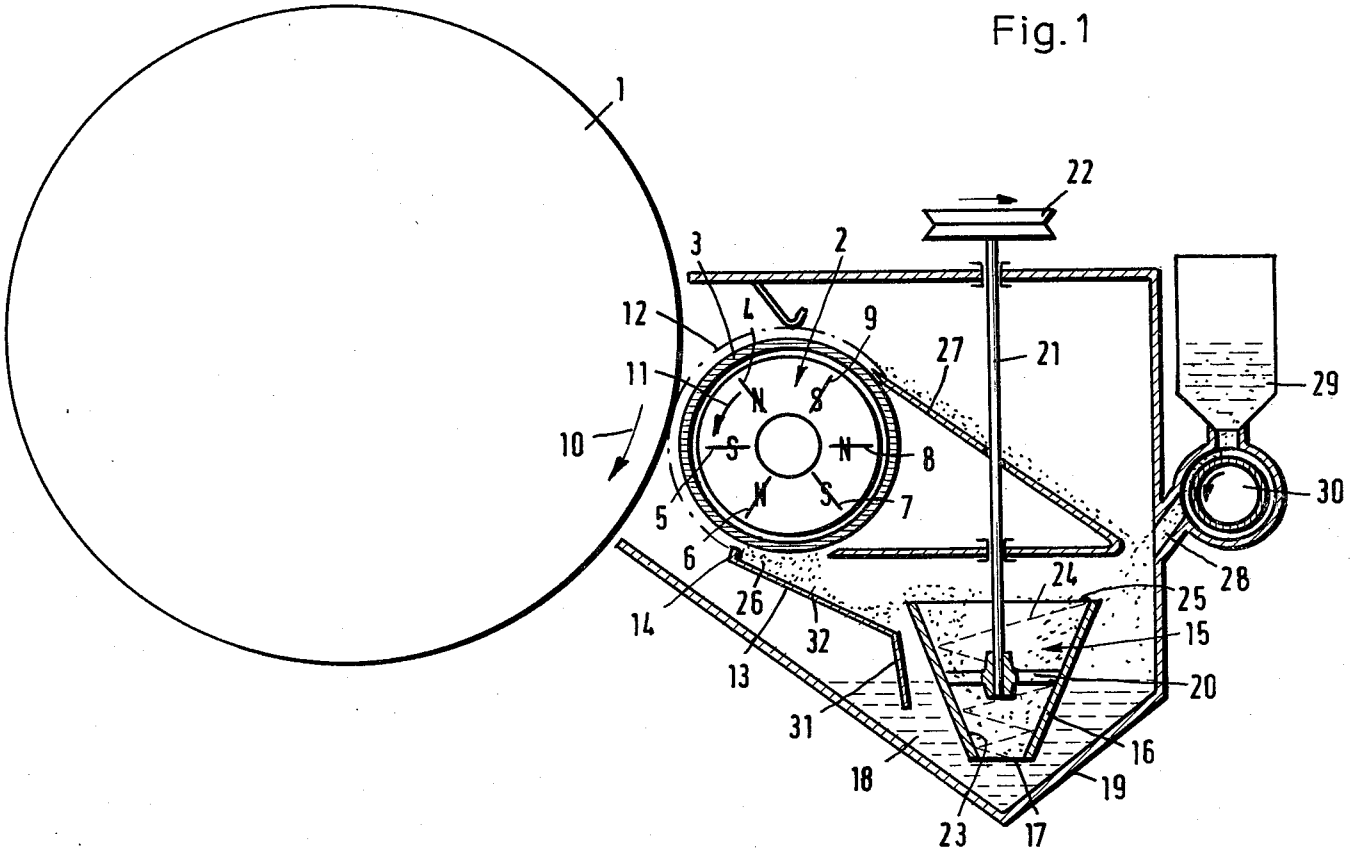
Figure 2:
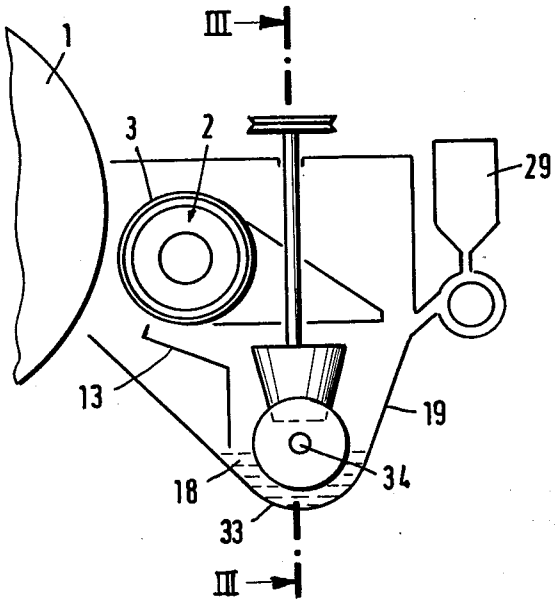
FIG. 2 is a view similar to FIG. 1 of another embodiment.

It should be remarked that FIGS. 1 and 2 are fragmentary views of a copying machine whereby a substantial member thereof, i.e. a drum for bearing the latent image upon exposure is only partially shown.

In the various FIGS. of the drawing similar parts are designated by the same reference numerals.

In a copying machine of the type as described, e.g. in the U.S. Pat. No. 3,062,108, is provided a drum 1 that is coated e.g. with a selenium layer that may likewise be enriched with other materials. By direct exposure of an original a latent image is generated on this layer which may be termed likewise "material". This latent image is then developed by the described developing apparatus. In the developing process, it is known that particles of pigment are deposited on the material or respectively on the drum 1 in correspondence with attraction forces, and the problem is to feed these pigment particles in a favorable manner.

Toward this end is employed a magnet drum 2 that rotates within a tubular sleeve 3. The magnet drum 2 includes about its circumference several poles of alternating North and South polarities, as shown in FIG. 1 by poles 4 to 9. The tubular sleeve 3 of a non-magnetizable material is stationary. When the drum 1 rotates in the direction of the arrow 10, the magnet drum 2 is rotated e.g. in the direction of the arrow 11, in order to obtain the required relative movement.

A magnetic powder brush indicated by 12 moves thereby along the stationary tubular sleeve 3 against the direction of rotation 11, from the bottom to the top of the tubular sleeve.

The developer powder of carrier and pigment particles is fed to the tubular sleeve 3 from below. Toward this end, there is provided a baffle sheet 13 approaching the lower apex of the tubular sleeve 3 and extending beyond this lower apex and having at its free end an upwardly bent portion 14. This bent portion 14 defines a stop for accumulated material. The spacing of the baffle sheet from the magnet drum or respectively the tubular sleeve is so small that the magnetic field of the magnet drum is effective likewise ahead of the bent portion 14 and acts on magnetizable developer powder.

In combination with the thus arranged baffle sheet 13 is provided means 15 in the form of a pump consisting of a hollow cone 16. This hollow cone dips, by its bottom edge 17, into a supply 18 of developer powder within a casing 19 of the developing apparatus. In approximately an intermediate range of its height the hollow cone is provided internally with a spider 20 and a drive shaft 21 mounting at its end extending from the casing 19 a drive means 22 such as optionally a pulley for rotating the hollow cone 16. The arms of the spider 20 may consist of vanes. The hollow cone 16 includes an upwardly enlarged wall member at the inner surface of which is urged upwardly the material entering through the bottom opening. The inner surface 23 may be provided with profilings such as one or several spiral threads 24 for enhancing the circulating movement. In the here shown embodiment the upwardly conveyed developer powder is projected from the upper edge 25 of the hollow cone and impinges onto the baffle sheet 13 at the side of the magnet drum 2 disposed between the drive shaft 21 and the cylinder drum 1. The developer powder hits the baffle sheet 13 substantially in an intermediate height thereof, for storing in this manner a supply bead 26 from which the magnet drum derives its brush supply. In the scope of the present invention, this bead defines, together with the slope of the baffle sheet 13 with respect to the upper height of the edge 25 of the hollow cone 16, an important element for uniform supply along its whole axial length of a magnet drum of a predetermined format. It should be mentioned explicitly that several conveyor means 15 of this type may be provided. The combination with the radial ejection of the developer powder, in influencing the adhesion forces between pigment and carrier particles, and the chute-type baffle sheet already within the range of a magnetic field to establish a supply and up to the region of the direct removal of magnetic brush material ensures thereby surprisingly a magnet drum feed and the replenishment by a concentrated section with respect to the length of a magnet drum or respectively a magnet drum section, in providing the advantage that replenishment need only be supplied to the concentrated section.

The stationary tubular sleeve 3 is engaged, beyond the apex of the upper region with respect to the brush rotation, by a stripper 27 by which the magnetic brush 12 or respectively the material defining this brush is being removed in the manner of a chute and is transported back into the supply 18. It is thereby preferred that the stripper which may be integral with the stationary tubular sleeve 3 extends up to a region into which opens likewise a feed conduit 28 supplied from a make-up reservoir 29. The discharge and supply device which is coupled to drive means for also the drum 1 is generally designated by the reference numeral 30 and rotates in the direction indicated by the arrow. This device may consist e.g. of a floc-carrying drum.

When the stripper 27 does not extend beyond the means 15, at least the portion extending on the right hand side of the drive shaft 21 is closed by a roof-type cover that may engage, by an edge, the wall portion 16, in order to prevent useless scattering.

The baffle sheet 13 includes at its end facing the means 15 a substantially vertically downwardly depending portion 31 which preferably dips into the supply 18 of developer powder.

In this manner is provided a mist barrier that is closed automatically by this supply. This mist barrier mutually separates two spaces. In the one space is disposed the means 15 with the trajectory of the developing powder onto the baffle plate 13, delimited by the bead-shaped stop ahead of the end 14 of the baffle sheet, and on the other side at most material thrown off the developer powder brush 12 drops along the casing wall 32 into the supply 18 whereby is safely prevented any whirling up by the means 15.

Figure 3:
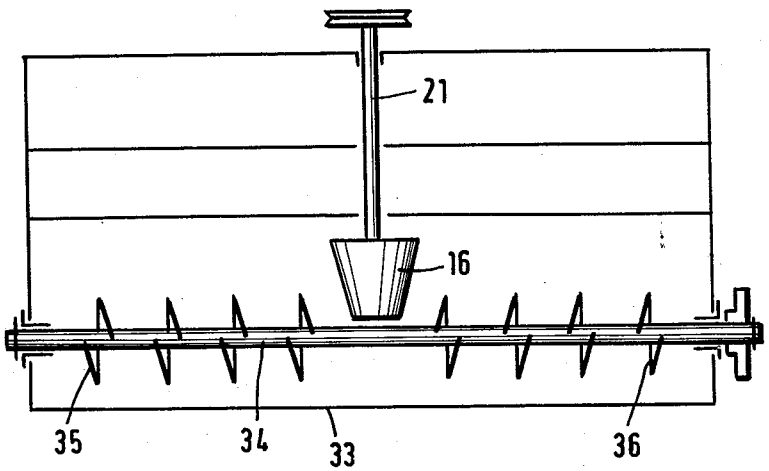
FIG. 3 is a sectional view along the line III—III of FIG. 2.

According to FIG. 1 the casing 19 may define a hopper converging downwardly on all sides below the means 15. According to FIGS. 2 and 3, the casing 19 includes a bottom wall or respectively a trough 33 extending parallel of the magnet drum 2, and a worm screw 34 is movable above this bottom wall. This worm screw 34 includes conveyor elements 35, 36 that are coaxial with the curvature of the bottom wall 33. The conveyor elements 35, 36 may consist of vanes, spiral threads or spiral thread sections of opposite feed directions on both sides of the drive shaft 21 so that material dropping off the baffle sheet 13 or returned into the supply 18 underneath the baffle sheet will be stirred up and transported toward the center below the conveyor and mixing means 15 which as described above not only effects the upward transport but likewise influences favorably the complex developer powder prior to the distribution thereof across the whole width.

Figure 4:
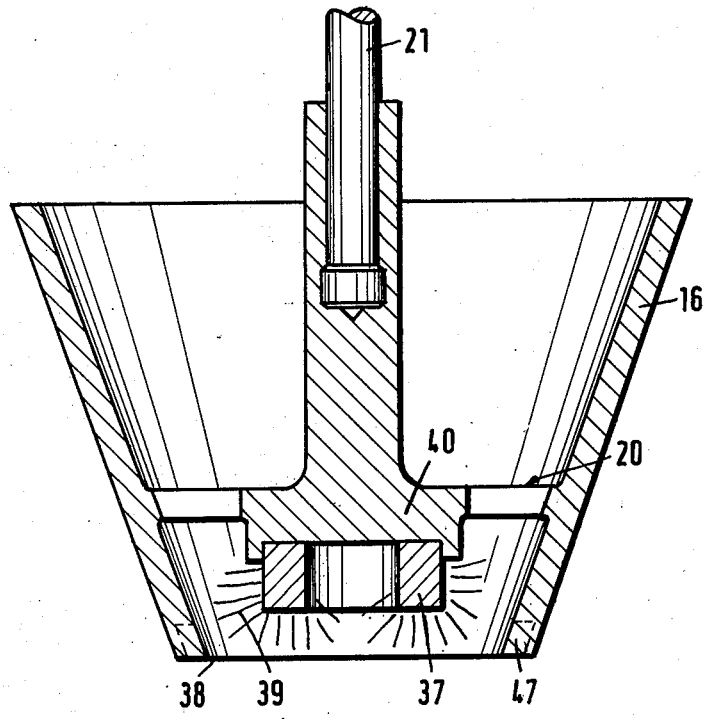
FIG. 4 is a fragmentary view showing a particular embodiment of the pump used.

According to FIG. 4 the spider 20 interconnecting the hollow cone 16 with the drive shaft 21 is provided, at its bottom surface, with an annular magnet 37 for attracting developer powder from the developer powder supply into the bottom opening 38 of the hollow cone 16, in defining its own brush 39. By the rotation of the hollow cone 16 and of the annular magnet 37 this brush is projected against the inner surface of the conical wall and migrates upwardly along this wall.

In the embodiment shown the spider 20 is provided with a hub 40 to which is attached the annular magnet. It is likewise possible to attach an annular magnet to the inner surface of the hollow cone 16 at the lower edge, as shown in broken lines at 41.

Figure 6:
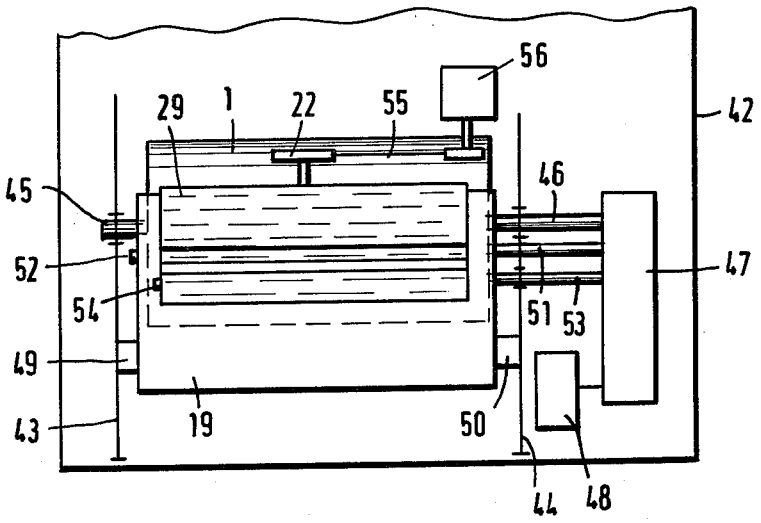
FIG. 6 is a schematical fragmentary sectional view of a copying machine with the developing apparatus, as seen from the right hand side in FIG. 1.
Figure 5:
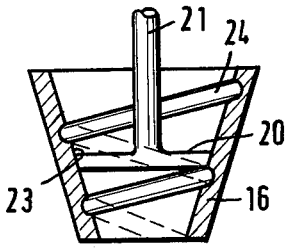
FIG. 5 is a view similar to FIG. 4 of another embodiment.

FIG. 6 illustrates a casing 42 with two side plates 43, 44. The assembly is mounted between these two side plates. It may be seen that the drum 1 engages the side plate 43 by a trunnion 45 and is journalled in the side plate 44 at the opposite side by means of a projecting shaft 46. The shaft 46 extends into a gear transmission 47 driven by the motor 48. The developer casing 19 is supported against the side plates by brackets 49, 50 respectively. From this casing extends laterally the shaft 51 of the magnet drum 2 into the gear transmission 47, whereby this shaft is journalled in the side plate 44. At the opposite end of the magnet drum, the shaft is journalled in the casing 19 at 52. In a similar manner the shaft 53 of the discharge and supply device 30 extends through the side plate 44 into the transmission 47. This shaft is journalled in an extension of the housing 19 whereby the bearing at the opposite side is indicated by the reference numeral 54. In this embodiment the drive means 22 consists of a disc that is connected by a gear unit 55 to a motor 56 which is mounted on the side plate 44.

What is claimed is:

1. A developing apparatus for developing a particularly electrostatically generated latent image on a drum-type carrier, the apparatus including a generally horizontally arranged magnet drum extending parallel to the drum-type carrier and adapted to generate a developer powder brush, the magnet drum having a first surface being spaced from the drum carrier so that the developer powder brush generated at the magnet drum moves past the drum-type carrier in contact therewith whereby the tips of the brush move relative to the drum carrier and a diametrically opposed second surface, said magnet drum having a lower surface located between the first and second surfaces, a casing having an opening therein toward the drum-type carrier, the magnet drum being rotatably mounted within said casing in the vicinity of the opening therein, the casing adapted to receive a supply of developer powder spaced downwardly from the magnet drum; at least one pumping means mounted within said casing below and on the side of said magnet drum adjacent to the second surface thereof and having a lower inlet end dipping into said supply of developer powder and an upper outlet end, wherein the improvement comprises a baffle sheet located within said housing below said magnet drum, said baffle sheet having an upper end located adjacent the lower surface of said magnet drum, at least a portion of the surface of said baffle sheet extending downwardly from the upper end thereof and inclined to the vertical toward the outlet end of said pumping means, said at least one pumping means arranged to direct developer powder from the outlet end thereof onto said at least a portion of said baffle sheet so that the developer powder reaches the lower surface of said magnet drum by sliding upwardly over said at least a portion of said baffle sheet; and first drive means for driving said magnet drum and second drive means for driving said pumping means.

2. A developing apparatus as defined in claim 1 wherein said upper end of said baffle sheet disposed below the lower surface of said magnet drum includes a bent portion extending upwardly from said at least a portion of the surface said baffle sheet and against which developer powder can accumulate for causing a bead-like developer powder distribution across the axial length of the magnet drum.

3. A developing apparatus as defined in claim 2, wherein the spacing of the upper end of said baffle sheet from the lower surface of said magnet drum is selected so that at the upper end of the baffle sheet the magnetic field defines a magnetic zone in which a bead-shaped supply of developer powder is retained from which the magnet drum makes up its brush replenishment.

4. A developing apparatus as defined in claim 1, wherein the at least a portion of the surface of said baffle sheet has a region located intermediate the upper and lower ends thereof arranged adjacent the outlet end of said pumping means so that the developer powder from the outlet end of said pumping means impinges on said intermediate region.

5. A developing apparatus as defined in claim 1, wherein the lower end of the baffle sheet includes a portion bent downwardly from the lower end of said at least a portion of the surface of said baffle sheet so that it dips into the supply of developer powder, and thereby provides a mist barrier at the lower end of said baffle sheet.

6. A developing apparatus as defined in claim 1, wherein the at least one pumping means includes a generally vertically arranged hollow cone adapted to be driven about its center axis, said cone at its lower inlet end arranged to dip into the supply of developer powder, and including means for conveying the developer powder along its inner surface toward its upper edge.

7. A developing apparatus as defined in claim 6, wherein the center axis of said hollow cone being inclined to the vertical so that the upper circumference thereof at the side adjacent the baffle sheet is disposed lower than the diametrically opposed side of the upper circumference.

8. A developing apparatus as defined in claim 6, wherein an annular magnet is provided in the lower portion of the hollow cone for dipping into the supply of developer powder.

9. A developing apparatus as defined in claim 8, wherein a spider is located with said hollow cone extending transversely of the center axis thereof, a drive shaft connected to and extending upwardly from said spider, and said annular magnet arranged at the lower surface of said spider.

10. A developing apparatus as defined in claim 9, wherein the outer diameter of said annular magnet is spaced radially outwardly from the inner diameter of the hollow cone.

11. A developing apparatus as defined in claim 6, wherein the inner surface of said hollow cone is provided with profilings.

12. A developing apparatus as defined in claim 11, wherein said profilings consist of a spiral thread machined in the direction of rotation.

13. A developing apparatus as defined in claim 1, wherein said magnet drum comprises a tubular sleeve made of a non-magnetizable material, a rotary magnet of axially extending magnets of alternately opposite polarities rotating within said stationary tubular sleeve, and a stripper mounted on said tubular sleeve for removing the magnet brush material of the developer powder, the stripper being disposed between the first and second surfaces of said magnet drum opposite the lower surface thereof.

14. A developing apparatus as defined in claim 6, wherein said casing comprises a hopper-shaped supply reservoir forming a sump, and said driven cone dips into the sump of said hopper-shaped supply reservoir.

15. A developing apparatus as defined in claim 14, wherein a screw conveyor is arranged within the sump including a trough corresponding to the width of the magnet drum, said screw conveyor including conveyor elements of a configuration for supplying developer powder to said at least one hollow cone.

* * * * *